United States Patent [19]

Sutherland

[11] 4,287,061

[45] Sep. 1, 1981

[54] ROTATING COIL CENTRIFUGE

[75] Inventor: Ian A. Sutherland, Harpenden, England

[73] Assignee: National Research Development Corporation, London, England

[21] Appl. No.: 88,054

[22] Filed: Oct. 24, 1979

[30] Foreign Application Priority Data

Oct. 26, 1978 [GB] United Kingdom ..... 42034/78

[51] Int. Cl.[3] ..... B01N 15/08

[52] U.S. Cl. ..... 210/198.2; 233/25

[58] Field of Search ..... 210/657, 198 C, 241, 210/329, 380 R, 324, 512 M; 53/386, 390; 233/25

[56] References Cited

U.S. PATENT DOCUMENTS

| | | | |
|---|---|---|---|
| 3,438,501 | 4/1969 | Oyen | 210/380 R |
| 3,586,413 | 6/1971 | Adams | 350/7 |
| 3,775,309 | 11/1973 | Ito et al. | 210/31 C |
| 3,856,669 | 12/1974 | Ito et al. | 210/31 C |
| 4,058,460 | 11/1977 | Ito | 210/198 C |
| 4,182,678 | 1/1980 | Ito | 210/198 C |

OTHER PUBLICATIONS

"Counter Current Chromatography with the Flow Through Centrifuge Without Rotating Seals", in Analytical Biochemistry 85, pp. 614–617, (1978).

*Primary Examiner*—John Adee

*Attorney, Agent, or Firm*—Cushman, Darby & Cushman

[57] ABSTRACT

In a centrifuge attachment for use in counter current chromatography, a centrifuge plate rotatable about a central axis carries either two or more convoluted (e.g. straight helical) coils or a single convoluted coil arranged as a toroid, the tube or tubes being convoluted about an axis of convolution which is generally perpendicular to the local direction of the centrifugal force generated by rotation of the plate. Inlet and outlet tubes are provided in a known manner such that they do not twist and the convulated coil is rotated about its axis of convolution at a speed which is independent of the speed of rotation of the centrifuge plate.

11 Claims, 12 Drawing Figures

Figure 3:
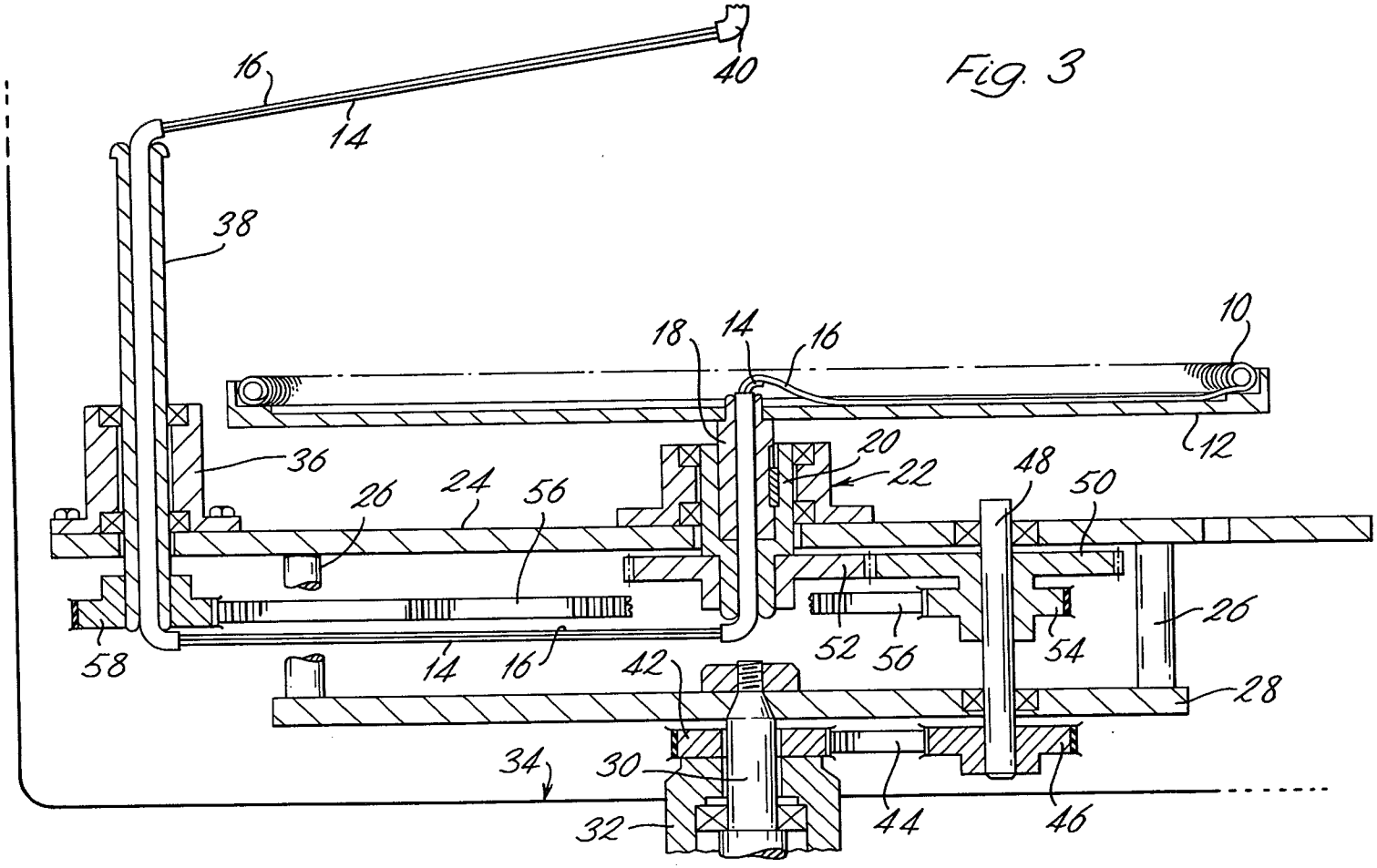

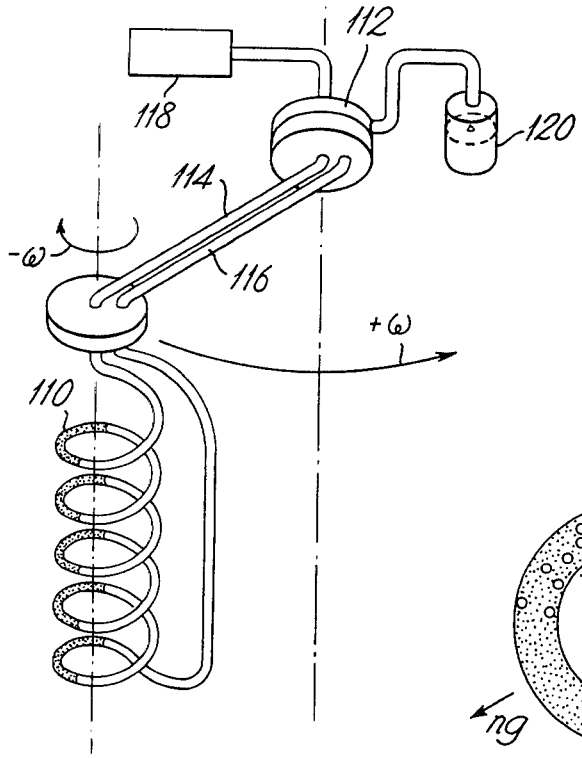
Fig. 1
Fig. 2
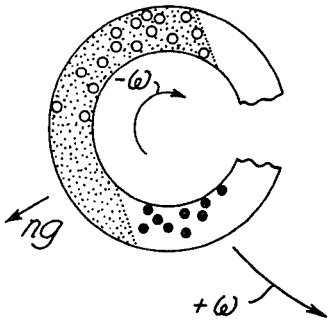
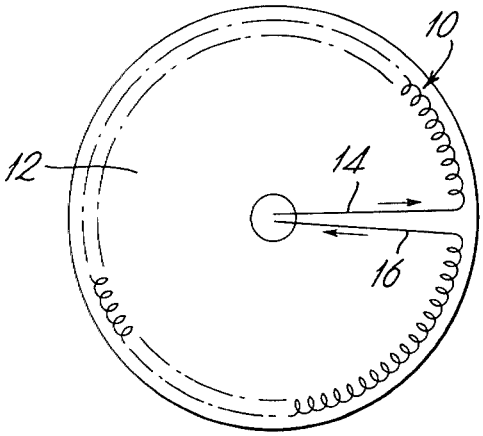
Fig. 4

ROTATING COIL CENTRIFUGE

This invention relates to a centrifuge which can carry a flow-through tube intended for use in counter-current chromatography.

In counter-current chromatography, two immiscible liquid phases are supplied to a helical coil which is rotated about its axis. If a sample is added which has greater affinity for one phase, and if this phase is supplied continuously to the coil, the sample is partitioned between the two phases in the continuous mixing process caused by the rotation, and will move through the flow-through coil at a speed which is a function of the partition coefficient while the other phase remains in the coil. The additional application of a gravitational field such as a centrifugal field enhances the retention of the other phase in the coil sectors, so that a high flow rate can be used without losing the static phase, and faster separation times are possible. The added sample may be a solute or may contain small particles; particles up to 1 micron in size have been successfully partitioned by the technique.

In U.S. Pat. Nos. 3,773,309, 3,856,669 and 4,058,400 Y. Ito discloses three forms of planetary centrifuge apparatus for elution centrifugation in which two rotary motions are applied to a helical separation column. However, the two motions are associated and cannot be altered independently, so that if a slow mixing rotation is required, only a low centrifugal field can be generated. This is not always desirable. To provide independent motions, a rotating seal would be necessary in each arrangement. In each case, dedicated apparatus is provided.

In a different approach described in "Analytical Biochemistry" Volume 85, page 614, 1968, Ito discloses a flow-through helical coil arranged as a toroid near the periphery of a centrifuge plate; this allows use of the high speeds available in a conventional centrifuge, but only one motion, the centrifugal rotation, is applied to the coil.

In all forms of Ito's apparatus the inlet and outlet tube connections to the separation coil are arranged so that they do not twist, in accordance with the principle disclosed by D. Adams in U.S. Pat. No. 3,586,413.

Attempts have been made to partition a liquid mixture containing large particles, which in this specification means particles larger than about 1 micron, typically being biological cells or viruses. Usually a mixture of two polymer phases is provided, and since the difference in their densities is small, a high centrifugal field is needed to keep the partition time to an acceptably low level.

In the prior art planetary centrifuges, if the apparatus is capable of achieving such a high centrifugal field, it is only in conjunction with a high mixing rotation speed which is undesirable because of emulsification of the two phases. If a rotating seal is used, the large particles may be damaged in its shear zone, and the seal may leak under high pressures. In a toroidal coil used on a conventional centrifuge but with no mixing rotation, the relatively large particles tend to sediment and do not move through the coil with the preferred phase as required.

According to the invention a centrifuge attachment comprises a centrifuge plate rotatable about a central axis; support means for supporting on the centrifuge plate at least one convoluted tube near the periphery of the plate the tube being convoluted about an axis of convolution which is generally perpendicular to the local direction of the centrifugal force generated by rotation of the plate; rotation means to rotate the at least one tube about an axis parallel to the axis of convolution during rotation of the centrifuge plate at a predetermined speed which is independent of the speed of rotation of the centrifuge plate; and means for supplying inlet and outlet tubes to the convoluted tube in a twist-free manner.

Usually the convoluted tube will be a helically coiled tube, the helix axis being generally perpendicular to the local centrifugal force, but alternatively the convoluted tube may be a sinusoidal tube, the sinusoidal undulations lying substantially in the plane of the centrifugal force.

The support means can support one or more straight-axis helical coils arranged on the centrifuge plate with the helix axis parallel to the centrifuge plate and tangential to the rotary movement of the centrifuge plate and the rotation means causes the or each coil to rotate about its helix axis. Conveniently there are two or more coils arranged symmetrically on the plate, but alternatively a single coil or an asymmetric arrangement of two or more coils can be used with one or more suitable counter-weights to balance the centrifuge.

In another arrangement, the or each straight axis coil is replaced by a set of straight axis helical coils, each set comprising an even number of coils with the coil axes parallel to the plate and spaced in a cylindrical array, the rotation means causing each cylindrical array to rotate about the cylinder axis.

When more than one coil or set of coils is provided, the twist-free connections must pass between the coils or sets in a circumferential direction.

In another arrangement the support means can support a single convoluted tube such as a single helical coil arranged around the plate periphery to form a toroid, the rotation means causing rotation of the coil about the circular centre line of the toroid.

Usually, the rotation of the at least one helical coil is caused by providing at the surface of the centrifuge plate a rotation which differs slightly in speed from the speed of rotation of the centrifuge plate. The centrifuge plate is fixed to a hollow central shaft, there being also provided a support tube which passes through the hollow central shaft and which is drivable at a slightly lower or slightly higher speed than the centrifuge plate, the inlet and outlet tubes passing through the support tube.

In a first important embodiment the hollow central shaft and the support tube are driven by a planetary drive gear chain via respective couplings having different gear ratios.

In a second important embodiment the central shaft and the support tube are driven by separate drive motors via separate gear chains.

In a centrifuge attachment according to the invention the means for supplying the inlet and outlet tubes to the at least one helical coil in a twist-free manner may comprise a hollow central shaft about which the centrifuge plate is rotatable; a tube holder which is parallel to the shaft and which is rotatable around the outside of the centrifuge plate in the same direction as and at half the speed of the rotation of the plate; and a fixed tube support in axial alignment with the central shaft.

The present invention also extends to a centrifuge having an attachment according to the invention.

In the accompanying drawings, the prior art will be described with reference to:

FIG. 1 which shows a rotating and planetary centrifuge with rotating seals; and FIG. 2 which illustrates mixing and separation within one coil segment of the planetary centrifuge.

FIG. 3 which shows another flow-through centrifuge in vertical section; and

FIG. 4 which shows the coil arrangement of the FIG. 3 centrifuge.

Figure 5:
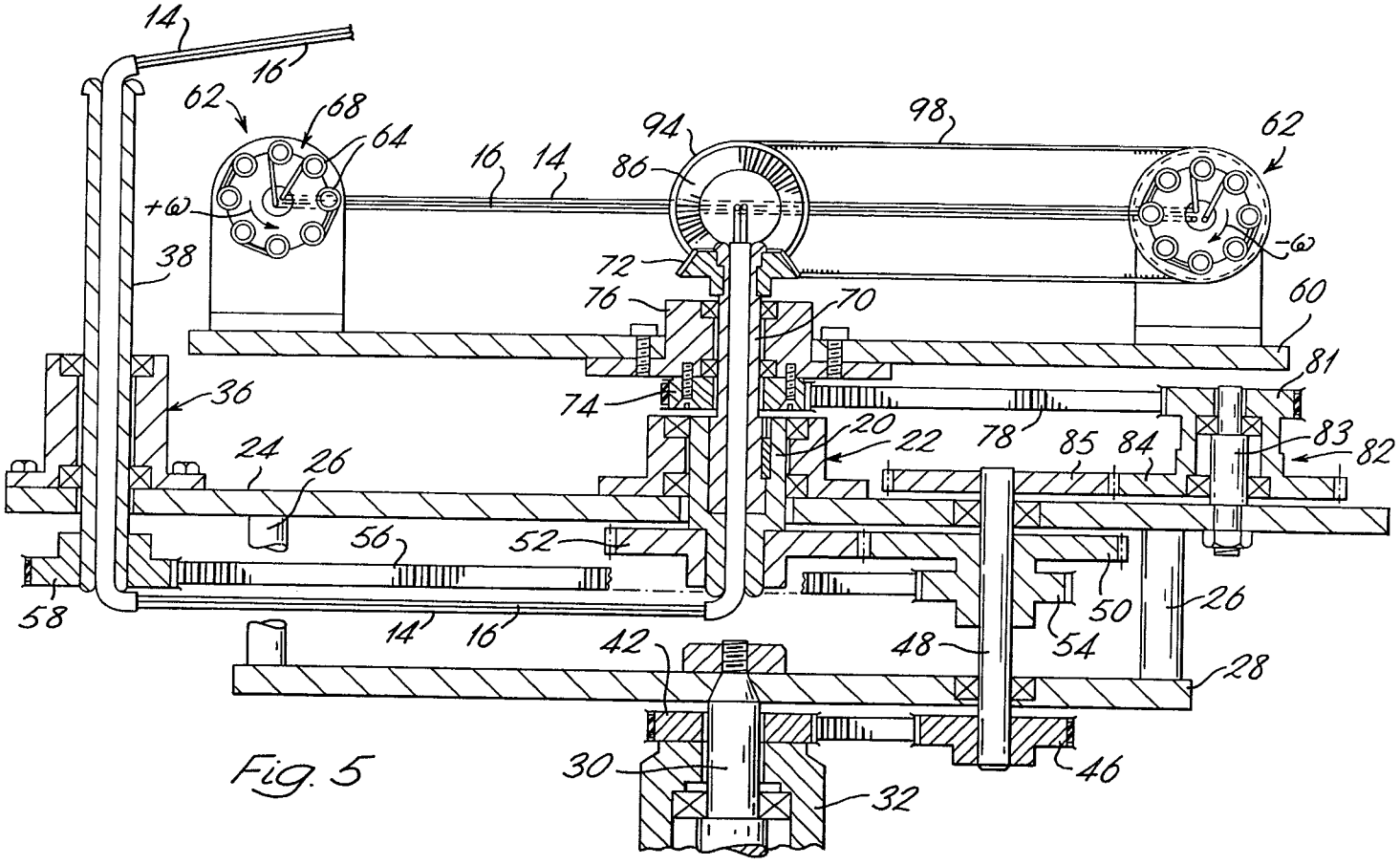
Figure 6:
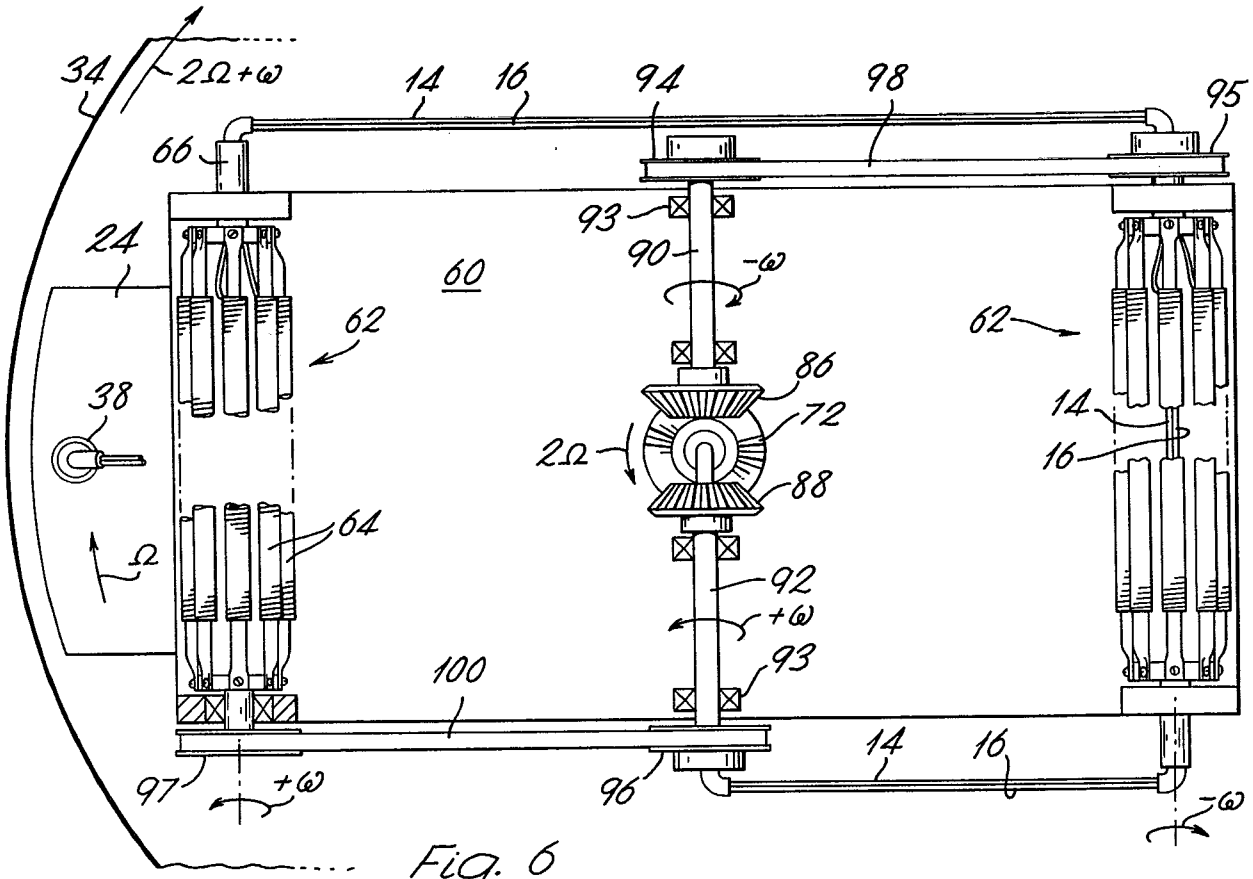
Figure 7:
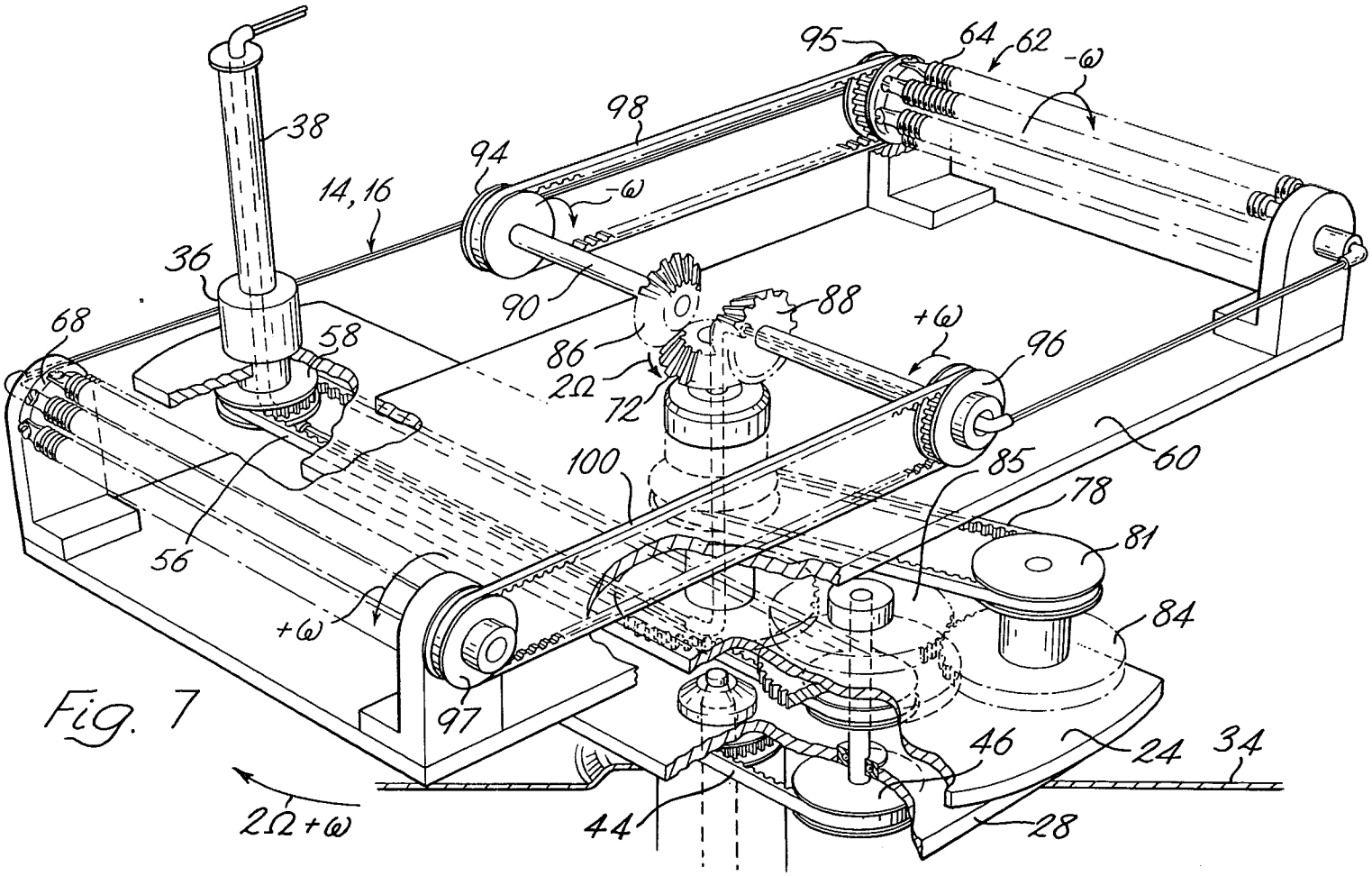
Figure 8:
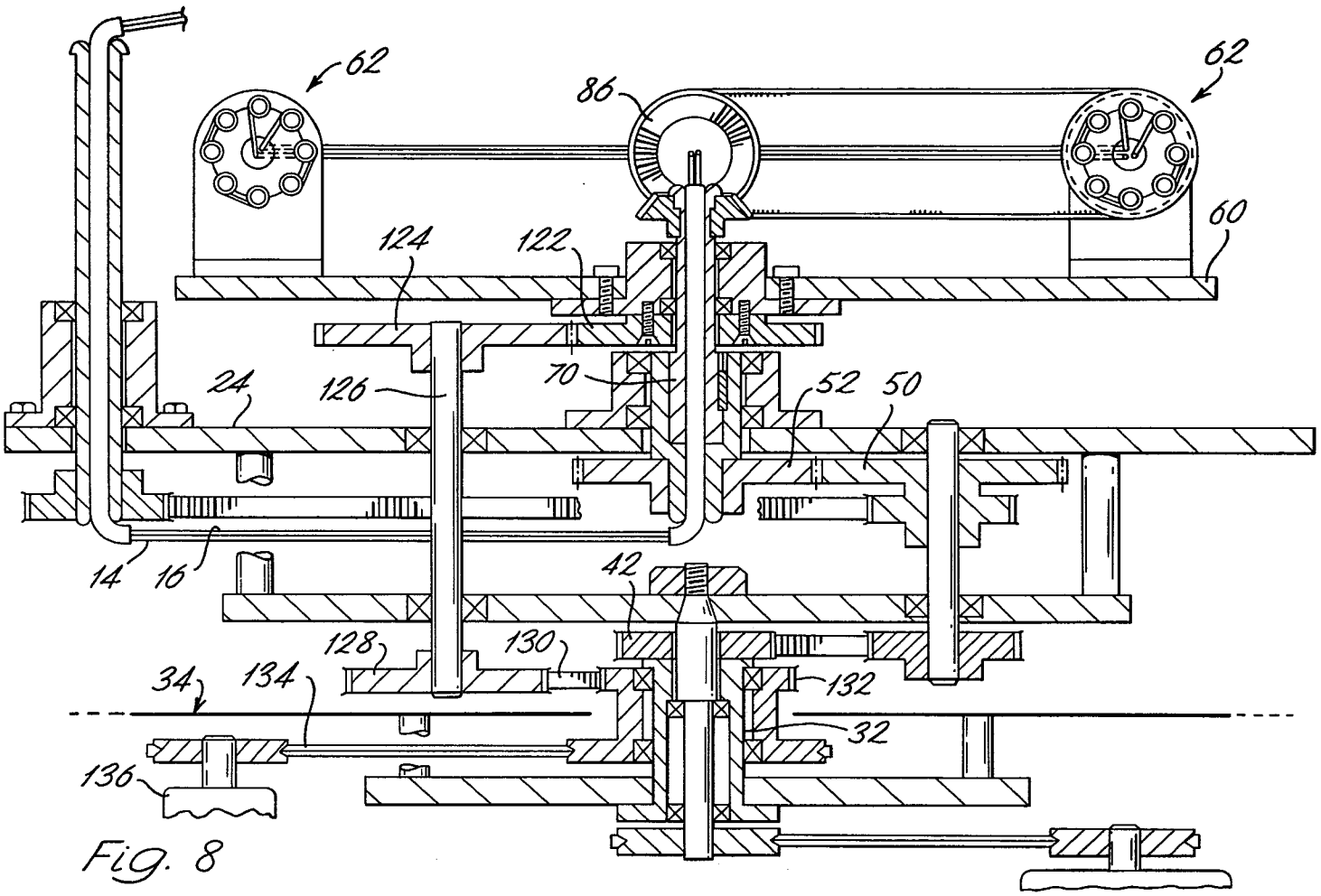
Figure 9:
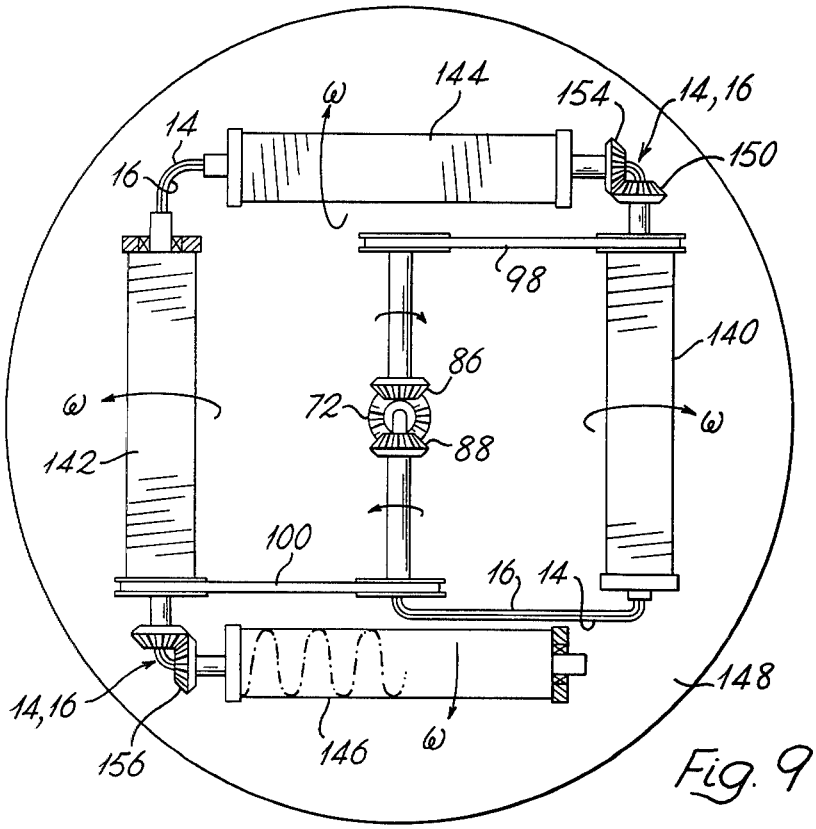
Figure 10:
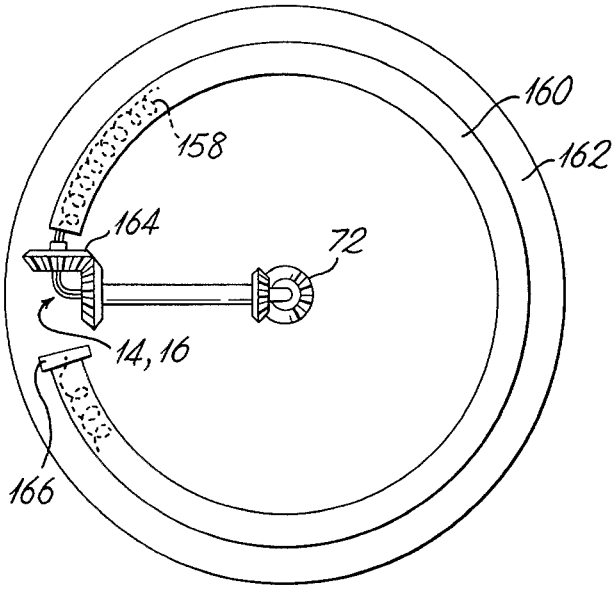
Figure 11:
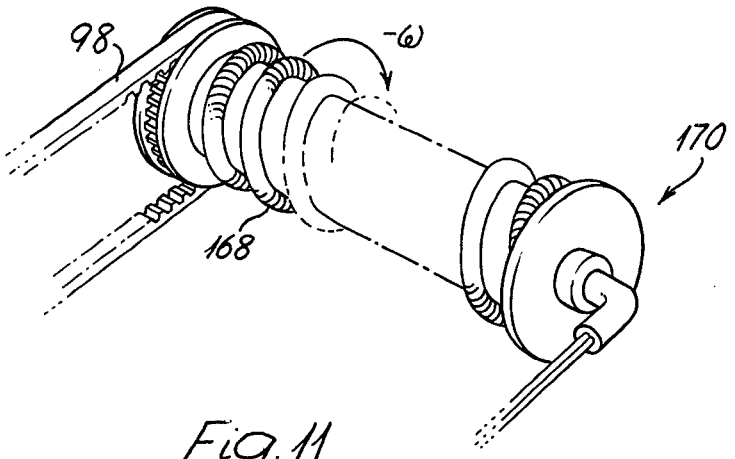
Figure 12:
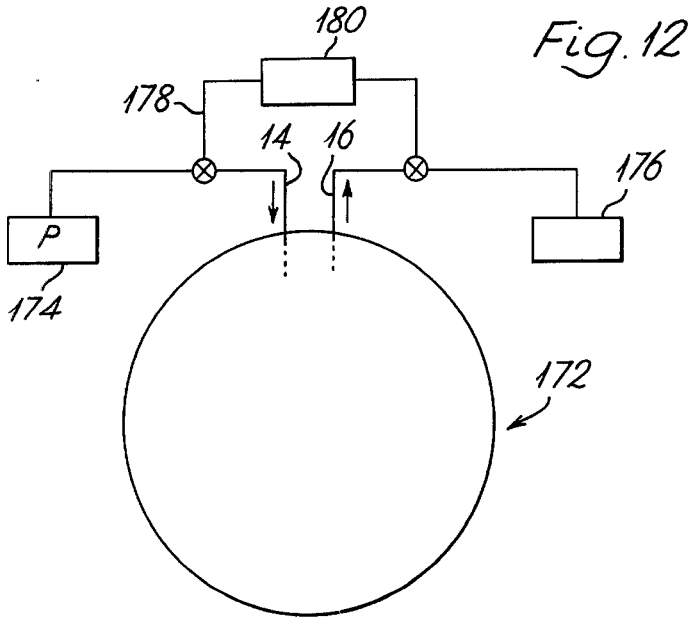

The invention will be described with reference to:

FIGS. 5, 6 and 7 which show respectively a vertical section, a view from above and a general view of a centrifuge attachment according to the invention;

FIG. 8 which shows in vertical section a centrifuge attachment according to the invention having an alternative drive mechanism;

FIGS. 9 and 10 which show in plan alternative arrangements of convoluted tubes;

FIG. 11 which is a partial view showing an alternative arrangement of the helical separation column; and FIG. 12 which shows the inventive apparatus with an external additional mixing facility.

In FIG. 1, a straight flow-through helical coil 110 is rotated about a central axis at velocity $\Omega$ and around it own axis at a much smaller velocity $\omega$ to give planetary motion. The coil is connected through a dual rotary seal 112 to inlet and outlet tubes 114, 116 which are respectively connected to a pump 118 and collection device 120.

If the coil is filled with two immiscible liquids of different density, the centrifugal force of the rotation $\Omega$ causes the more dense phase to move to the outer segment of each coil, as shown by the shading; the direction "out" is determined by the centrifugal acceleration field. The effect of the rotation of the helix about its own axis in a gravitational field is shown schematically in FIG. 2; the relatively slow rotation $\omega$ causes the two phases to mix within each coil turn; when the lighter phase passes the outermost part of the coil, it moves inwards through the heavier phase, as shown by the circles, and the denser phase moves over the top of the coil and outwards through the heavier phase, as shown by the large dots. There is thus improved mixing as the phases move through each other, and the effect of the rotation is to minimise sedimentation.

In the alternative flow-through centrifuge shown in FIGS. 3 and 4, which is a design by the present inventor based on Ito's arrangements, a helical coil 10 is arranged near the periphery of a centrifuge plate 12 to form a toroid; the ends of the coil form the inlet and outlet tubes 14, 16 and are lead through the hollow central stub shaft 18 of the plate 12. The stub shaft 18 is keyed to a central support shaft 20 which can rotate in a central bearing housing 22 attached to a first horizontal base plate 24, which is attached by vertical pillars 26 to a second horizontal base plate 28. The second base plate is rotatable by main drive shaft 30, which is supported in a main drive shaft bearing housing 32 passing through the fixed centrifuge bowl 34.

The first base plate 24 carries near its periphery a support tube bearing housing 36 which carries a vertical support tube 38 and allows rotation of the tube about its own axis. The inlet and outlet tubes 14, 16 passing down through the stub shaft 18 pass radially outwards, up through the support tube 38 past the edge of the plate 12, then radially inwards to a central tube support 40 above the centre line of the centrifuge bowl. The distance of the support tube 38 from the central axis of the apparatus is greater than the maximum radius of the centrifuge plate 12.

Considering now the drive mechanism, the main drive shaft 30 is driven by a first motor (not shown) below the centrifuge bowl 34. The fixed bearing housing 32 supports a stationary toothed pulley 42 which carries a first toothed belt 44 which passes round a lower first lay shaft toothed pulley 46 carried by a first lay shaft 48 which rotates in bearings fixed to the first and second base plates. The upper end of shaft 48 carries below the first base plate 24 a lay shaft spur gear 50 which meshes with a support shaft spur gear 52 which drive the central support shaft 20, and thus rotates the centrifuge plate 12.

The lay shaft 48 also carries an upper first lay shaft toothed pulley 54 which carries a second toothed belt 56 which drives a support tube toothed pulley 58 attached to the lower end of support tube 38.

Suppose first that the base plates 24 and 28 are held stationary, and the stationary pulley 42 can be rotated anti-clockwise at velocity $\Omega$; the lay shaft 48 is rotated in the same direction and at the same speed by the toothed belt 44, and this motion is transmitted by belt 56 to the support tube pulley 58, so that the support tube 38 is also rotated anti-clockwise at velocity $\Omega$. The spur gear 50 drives the support shaft spur gear 52, and therefore the support shaft 18, at the same speed but in the opposite direction i.e. clockwise. The rotations are shown in the truth chart, Table I, and indicate the relative movements of parts of the apparatus.

In use, the base plates 24 and 28 will be driven by the axle 30; suppose they are rotated clockwise at velocity $\Omega$; the stationary pulley 42 is, of course, stationary, and belt 44 constrains the pulley 46, and lay shaft 48 to be stationary. One result is that the support tube 38, rotating with the base plate 24, is constrained so that it always presents the same face to an observer outside the apparatus, i.e. there is planetary motion. Another result is that the spur gear 52 and stub shaft 18 rotate at velocity $2\Omega$ in a clockwise direction, see Table I.

Consider now the effect on the inlet and outlet tubes, which are fixed at the central tube support 40, are fixed in the support tube 38 and are fixed as they pass through the support shaft 18.

Since the support tube 38 rotates with base plate 24 in planetary motion, there is no twist of the tubes between the support 40 and the support tube 38.

Referring now to Table I, when the base plates 24, 28 are held stationary, the support tube 38 and the support shaft 18 rotate at the same speed in opposite directions; the result is that the inlet and outlet tubes roll over each other but do not twist. When the base plates 24, 28 rotate, the support tube 38 rotates around the support shaft 18 in the same direction and at half the speed; again, the result is that the inlet and outlet tubes roll over one another between tube 38 and shaft 18, but do not twist. A clear explanation of this phenomenon is given by Adams in U.S. Pat. No. 3,586,413.

TABLE I

| | Base Plates 14 and 28 | Stationary pulley 42 | Lay shaft 48 | Support tube 38 | Stub shaft 18 |
|---|---|---|---|---|---|
| Framework Stationary Rotate | 0 | $-\Omega$ | $-\Omega$ | $-\Omega$ | $+\Omega$ |
| Framework at + | + 106 | $+\Omega$ | $+\Omega$ | $+\Omega$ | $+\Omega$ |

TABLE I-continued

| | Base Plates 14 and 28 | Stationary pulley 42 | Lay shaft 48 | Support tube 38 | Stub shaft 18 |
|---|---|---|---|---|---|
| Resultant | + Ω | 0 | 0 | 0 | +2 Ω |

The overall result is that the inlet and outlet tubes 14, 16 can be connected to the helical coil, which is fixed to a rotatable centrifuge plate, without the use of a rotating seal.

However, to prevent sedimentation within the helical coil 10, it would be necessary to rotate the coil in FIGS. 3 and 4 about its own circular axis, in a manner equivalent to that shown in FIG. 1. When larger particles are to be partitioned, it is preferable to avoid rotating seals, especially if the flow provides high pressure. To allow high flow rate while retaining the static liquid phase, it is preferable to use an arrangement in which high centrifugal fields can be applied.

The conflicting requirements of good mixing (obtained at high coil rotation speeds) and the retention of one phase relative to the other (obtained at low coil rotation speeds) make it clearly beneficial to keep the mixing and centrifugal motions independent. This is possible in apparatus according to the present invention.

Referring now to FIGS. 5, 6 and 7, in which parts of the apparatus identical to FIGS. 3 and 4 are given the same reference numerals, a modified detachable centrifuge plate 60 carries two sets 62 of helical coils arranged diametrically opposite each other. Each set comprises eight straight coils 64 with their axes horizontal and equispaced in a cylindrical array; the coil axes and the cylinder axis of each set are parallel to the plate 60 and also parallel to a tangent to the direction of rotation of the centrifuge plate 60; the coils are carried by stub axles 66. The axles 66 cause slow rotation of the cylindrical array around the cylinder axis. Thus each helical coil is rotated about an axis parallel to its own axis in addition to its rotation on the centrifuge plate, the centrifugal force of this latter rotation being perpendicular to the axis of the helix at a position halfway along each helix.

Each set of coils is connected to inlet and outlet tubes 14, 16; the connection will be described in detail below. The tubes pass through a central aperture in the centrifuge plate 60 as before.

The drive mechanism in FIG. 5 is more complicated than in FIG. 3; the overall effect is to provide at the modified centrifuge plate 60 two rotational movements at slightly different speeds, and to use this difference to rotate the coil sets 62 about horizontal axes.

The central support shaft 20 now carries a rotating coil stub shaft 70 carrying a central bevel gear 72 at its upper end. The stub shaft 70 passes through a centrifuge plate drive pulley 74 above the central bearing housing 22, and this pulley is attached to the lower end of a centrifuge plate bearing housing 76 to which the modified centrifuge plate 60 is fixed. From the drive pulley 74 a third toothed belt 78 passes to a toothed pulley 81 on an idler assembly 82 carried by a fixed idler shaft 83 mounted on the first base plate 24. The idler assembly 82 also comprises a spur gear 84 which meshes with a lay shaft change gear 85 above plate 24 and carried by an extension of first lay shaft 48. The shaft 70 is keyed to the support shaft spur gear 52.

As in the prior art arrangement, the gear 50 drives the gear 52 and the shaft 70 at a speed 2Ω in a clockwise direction. The additional gears 84, 85, idler pulley 81 and drive pulley 74 are chosen so that the bearing housing 76 and the modified centrifuge plate 60 are driven in a clockwise direction at a speed differing by a small amount ω from 2Ω; the speed may be either (2Ω+ω) or (2Ω−ω); the stub shaft 70 and further bearing housing 76 therefore rotate at a relative speed 107. Typically ω is 7 rpm and 2Ω is 1000 rpm, but the ratios of gears 84, 85 and 82 can be changed to vary the magnitude and direction of the relative rotation.

Referring now particularly to FIG. 6, the bevel gear 72 carried at the top of the stub shaft 70 meshes with first and second differential bevel gears 86, 88 caried caried by respective first and second hollow half shafts 90, 92 which are rotatably supported by bearings 93 attached to the modified centrifuge plate 60. The half shafts carry at their respective outer ends first and second half shaft toothed pulleys 94, 96, carrying respectively fourth and fifth toothed belts 98, 100 connected via pulleys 95, 97 each to drive one of the axles 66 of the coil systems 62.

As explained above, there is a slow relative rotation ω between the centrifuge plate 60 and the stub shaft 70 carrying the bevel gear 72. Consider FIG. 6 from the point of view of an observer rotating with the plate 60; the bevel gear 72 rotates at speed ω; suppose this rotation is anti-clockwise; then bevel gear 88 and half shaft 92 are also rotated at speed ω as indicated by the arrow, and this rotation is transferred by the belt 100 to the left-hand coil set 62; the helical coils 64 are therefore rotated about the axis of the supporting cylinder at velocity ω, because pulleys 96 and 97 are identical; this slow rotation of the coils while the centrifuge plate is spinning prevents sedimentation of any particles within the coils.

The right-hand coil set 62 is driven by half shaft 90 and belt 98 to rotate in the opposite direction to the left-hand coil set.

The inlet tube 14 passes upwards through the stub shaft 70, through the centres of bevel gears 72 and 88, through the half shaft 92 and pulley 96, then to the axis of the right-hand coil set. After series connection to all of the coils in that set, the tube passes through the centre of pulley 95 to the centre of the right-hand coil set to the left-hand coil set. From this same end of the left-hand coil set, the outlet tube follows the same path as the inlet tube back to the centre of bevel gear 72.

Referring now particularly to FIG. 5, the toothed belts rotate the coil sets 62 so that the left-hand set rotates anti-clockwise and the right-hand set rotates clockwise. The inlet tube 14 and the outlet tube 16 therefore roll over each other between the sets, but do not twist. Similarly, the tubes roll but do not twist between the half shaft 92 and the right-hand coil set, and between the half shaft and the end of stub shaft 70.

In the embodiment just described, the relative magnitudes of Ω and ω can be altered by altering the gear ratios in the driving mechanism so that a single centrifuge attachment can be used at high centrifugal fields but with either relatively fast or slow rotation of the helical coils about their axes.

An alternative arrangement for providing the coil rotation is shown in FIG. 8. The modified centrifuge plate 60 and all items of apparatus above it are unchanged. The plate 60 rotates about a stub shaft 70, which is driven by the gear 52 as before but the drive pulley 74 is replaced by a centrifuge plate drive gear 122 which meshes with a second lay shaft spur gear 124 carried by a second lay shaft 126 rotatably mounted in the first and second base plates 24, 28. The second lay shaft 126 is arranged symmetrically with the first lay shaft 48, and carried at its lower end a toothed pulley 128 which carried a sixth toothed belt 130 which passes round a secondary drive assembly 132 which rotates around the fixed bearing housing 32.

If the assembly 132 was fixed, similarly to the pulley 42 immediately above it, the gear train would drive gear 122 in exactly the same direction and at the same speed as the drive derived from the gear train on the first lay shaft 48. Instead, however, the assembly 132 is arranged to be rotatable on the bearing housing 32 and is driven through a V-belt drive 134 by a second motor 136 outside the centrifuge bowl 34; the second motor, rotating at speed $\omega$ provides rotary motion $(2\Omega+\omega)$ to gear 122 so that the centrifuge plate 60 rotates at a slow speed $\omega$ with respect to the rotation of the stub shaft 70 and the bevel gear 72. This relative rotation is used to rotate the coil sets 62 about their axes as before.

In this arrangement, to avoid coincidence of the lay shaft 125 and the inlet and outlet tubes 14, 16 as they pass between the centre and periphery of the apparatus, either the tubes or the shaft must be slightly offset. There is no relative rotation of these items about the central axis of the apparatus.

A particular advantage of this second embodiment is that the speeds $\Omega$ and $\omega$ can be varied independently by altering the speeds of the respective driving motors for example by stepping motors. This allows the relative magnitudes of the speeds to be altered during a single application of counter-current chromatography without interruption. For example, the mixing rotation of the helical coils about their axes can be made initially fast to mix the immiscible liquid phases, then can be slowed down to allow re-coagulation of the droplets so formed. While in this state, the pump can be indexed to transfer the mobile phase from one coil to the next while the stationary phase is retained by the high centrifugal forces and the slow coil rotation. The maintenance of slow coil rotation is necessary to avoid sedimentation. This sequence is then repeated.

Both embodiments of a centrifuge according to the invention have been illustrated in which two sets of coils each contain eight straight helical coils. Such an arrangement is not essential; each set may contain any number of coils, or may comprise a single coil. Instead of two coil sets a greater number, equispaced around the periphery of the centrifuge plate and with their axes each parallel to a local tangent to the centrifugal rotation may be used; the inlet and outlet tubes will then pass from a first set successively to all sets and return by the same route to avoid twisting. This principle is illustrated in highly schematic form in FIG. 9 in which four straight-axis convoluted tubes 140, 142, 144, 146 are carried by a centrifuge plate 148. Three of the tubes are coiled helically, but tube 156 is convoluted sinusoidally. Two opposite coils 140, 142 are driven by bevel gears 72, 86, 88 and belts 98, 100 as shown in FIG. 7. In the FIG. 9 arrangement, the axes supporting coils 140, 142 carry further bevel gears 150, 152 which mesh with bevel gears 154, 156 to rotate the convoluted tubes 144, 146. The rotations $\omega$ are indicated by the arrows.

The inlet tube 14 passes from the central bevel gear 72 to tube 140, then joins tubes 144, 142 and 146 in sequence. The outlet tube 16 returns by the same route.

By increasing the number of convoluted tubes spaced around the periphery of the centrifuge plate, one can consider that, in the limit, a single convoluted tube is reached. This is illustrated in FIG. 10. A single helical tube 158 with a circular helix axis is constrained within an outer tube 160 near the periphery of a centrifuge plate 162. One end of the helical tube is attached to a bevel gear 164 driven by a suitable connection to central bevel gear 72, and the other end of the tube is attached to a suitable rotary support 166. The tube 158 is therefore rotated about its circular helix axis by the bevel gear 164 and constrained by the tube 160 to retain its shape.

While the invention has so far been described with reference to straight-axis convoluted coils or a toroidal coil, other arrangements are possible. For example in FIG. 11 a helical coil 168 is wound on a bobbin-shaped former 170 to form a second helix. The bobbin is rotated by the drive belt 98 (see FIG. 7) and the coiled tube is rotated about the axis of this second helix.

When relatively large particles are to be partitioned, it may in some circumstances be necessary to apply an additional mixing process in addition to the coil rotation. In the embodiments according to the invention this further process can be applied in an external system connected to the helical coils. An example of such a centrifuge system is illustrated in FIG. 12. The centrifuge attachment is illustrated highly schematically, reference 172, showing the inlet and outlet tubes 14, 16. A pump 174 supplies one phase to inlet tube 14, and the outlet tube 16 carries partitioned liquid to a testing station 176. A bypass loop 178, which includes a mechanical or ultrasonic vibrator 180, can be connected between the tubes 14, 16, to give flow round a closed circuit which includes the convoluted coils in which the two phases of liquid are mixed. On disconnection of the bypass loop the pump 174 starts to operate and partitioned liquid can be analysed at the testing station 176. This arrangement can only be used when large particles are present in the liquid if there are no rotating seals; otherwise the high pressures generated by the mixing process may cause the large particles to be damaged in the shear zone of the seals.

It is a particular advantage of a centrifuge attachment according to the invention that it can be used in conjunction with a conventional centrifuge, as an alternative to a conventional centrifuge rotor. It is of course also possible that the arrangement according to the invention can form a permanent centrifuge arrangement.

I claim:

1. A centrifuge attachment comprising a centrifuge plate fixed to a hollow central shaft; first rotation means to rotate the hollow central shaft whereby the centrifuge plate rotates about a central axis; a support tube which passes through the hollow central shaft; second rotation means to rotate the support tube at a speed which differs slightly from the speed of rotation of the hollow central shaft; support means for supporting on the centrifuge plate at least one convoluted tube near the periphery of the plate, the tube being convoluted about an axis of convolution which is generally perpendicular to the local direction of the centrifugal force generated by rotation of the centrifuge plate; connection means between the support tube and the at least one convoluted tube whereby the at least one convoluted tube is rotated about an axis parallel to the axis of convolution during rotation of the centrifuge plate and at a predetermined speed which is independent of said rotation; and means for supplying inlet and outlet tubes to the at least one convoluted tube in a twist free manner, the inlet and outlet tubes passing through the support tube.

2. A centrifuge attachment according to claim 1 which is driven by a drive motor and a planetary drive gear chain, the first and second rotation means being first and second couplings to the gear chain having different gear ratios.

3. A centrifuge attachment according to claim 1 which is driven by two drive motors, the first and second rotation means being respective first and secondary planetary drive gear chains.

4. A centrifuge attachment comprising a centrifuge plate fixed to a hollow central shaft; support means for supporting on the centrifuge plate at least one convoluted tube near the periphery of the plate, the tube being convoluted about an axis of convolution which is generally perpendicular to the local direction of the centrifugal force generated by rotation of the plate; first rotation means to rotate the hollow central shaft whereby the centrifuge plate is rotated about the central axis; second rotation means to rotate the at least one tube about an axis parallel to the axis of convolution during rotation of the centrifuge plate and at a predetermined speed which is independent of the speed of rotation of the centrifuge plate; a tube holder which is parallel to the hollow central shaft and which is rotatable around the outside of the centrifuge plate in the same direction as and at half the speed of the rotation of the hollow central shaft; and a fixed tube support in axial alignment with the central shaft.

5. A centrifuge attachment according to claim 4 in which the at least one convoluted tube is at least one helically coiled tube, the helix axis being generally perpendicular to the local centrifugal force.

6. A centrifuge attachment according to claim 5 in which the support means can support an even number of straight helical coils arranged symmetrically on the centrifuge plate with their axes parallel to the centrifuge plate and tangential to the rotary movement of the centrifuge plate; the rotation means causing each coil to rotate about its helix axis.

7. A centrifuge attachment according to claim 5 in which two sets of helical coils are arranged diametrically opposite each other on the centrifuge plate, each set comprising an even number of coils with the coil axes parallel to the plate and spaced in a cylindrical array, the rotation means causing each cylindrical array to rotate about the cylinder axis.

8. A centrifuge attachment according to claim 5 in which the support means supports a cylindrical former on which a helical coil is wound as a second helix, the axis of the second helix being parallel to the centrifuge plate and tangential to the rotary movement of the centrifuge plate, the rotation means causing the cylindrical former to rotate about the axis of the second helix.

9. A centrifuge attachment according to claim 4 in which the support means supports a single helical coil arranged around the plate periphery to form a toroid, the rotation means causing rotation of the coil about the circular center line of the toroid.

10. A centrifuge attachment according to claim 4 in which the at least one convoluted tube is at least one tube having sinusoidal undulations lying substantially in the plane of the centrifugal force and the axis of the sinusoidal undulations being generally perpendicular to the local centrifugal force.

11. A centrifuge comprising a centrifuge plate fixed to a hollow central shaft; first rotation means to rotate the hollow central shaft whereby the centrifuge plate rotates about a central axis; a support tube which passes through the hollow central shaft; second rotation means to rotate the support tube at a speed which differs slightly from the speed of rotation of the hollow central shaft; support means for supporting on the centrifuge plate at least one convoluted tube near the periphery of the plate, the tube being convoluted about an axis of convolution which is generally perpendicular to the local direction of the centrifugal force generated by rotation of the centrifuge plate; connection means between the support tube and the at least one convoluted tube whereby the at least one convoluted tube is rotated about an axis parallel to the axis of convolution during rotation of the centrifuge plate and at a predetermined speed which is independent of said rotation; and means for supplying inlet and outlet tubes to the at least one convoluted tube in a twist free manner, the inlet and outlet tubes passing through the support tube; and drive means connected to the first and second rotation means.

* * * * *

UNITED STATES PATENT AND TRADEMARK OFFICE

CERTIFICATE OF CORRECTION

PATENT NO. : 4,287,061

DATED : September 1, 1981

INVENTOR(S) : Ian Alexander SUTHERLAND

It is certified that error appears in the above—identified patent and that said Letters Patent is hereby corrected as shown below:

Column 4, line 68, for "+106" read -- +Ω --

Signed and Sealed this

*Second* Day of *February 1982*

[SEAL]

*Attest:*

GERALD J. MOSSINGHOFF

*Attesting Officer*

*Commissioner of Patents and Trademarks*